US005390833A

United States Patent [19]

Baumann

[11] Patent Number: 5,390,833

[45] Date of Patent: Feb. 21, 1995

[54] ROOM SPRAY DISPENSER

[75] Inventor: Manfred Baumann, Diepoldsau, Switzerland

[73] Assignee: CWS International AG, Baar, Switzerland

[21] Appl. No.: 109,130

[22] Filed: Aug. 19, 1993

[30] Foreign Application Priority Data

Aug. 21, 1992 [CH] Switzerland ..... 02609/92

[51] Int. Cl.[6] ..... B67D 5/00

[52] U.S. Cl. ..... 222/505; 222/180; 239/274

[58] Field of Search ..... 222/160, 162, 180, 181, 222/505; 239/274

[56] References Cited

U.S. PATENT DOCUMENTS

| | | | |
|---|---|---|---|
| 2,178,888 | 11/1939 | Feldstein | 239/274 X |
| 2,795,799 | 6/1957 | Dickerman | 222/505 X |
| 3,033,471 | 5/1962 | Horn | 239/274 |
| 3,090,528 | 5/1963 | Ellis | 222/505 X |
| 4,056,228 | 11/1977 | Rosenkrantz et al. | 239/274 |
| 4,068,575 | 1/1978 | Difley et al. | 239/274 X |
| 4,202,471 | 5/1980 | Fegley | 222/505 X |
| 4,579,261 | 4/1986 | Arabian et al. | 222/505 |
| 4,789,083 | 12/1988 | Gutierrez | 222/505 X |

FOREIGN PATENT DOCUMENTS

| | | | |
|---|---|---|---|
| 2553303 | 4/1985 | France . | |
| 2653101 | 4/1991 | France | 239/274 |

*Primary Examiner*—Andres Kashnikow
*Assistant Examiner*—Kenneth DeRosa
*Attorney, Agent, or Firm*—Schweitzer Cornman & Gross

[57] ABSTRACT

A room spray dispenser includes an adjustable triggering lever having a roller to engage a moving object, such as a door, to activate the spray. Rotation of the lever in a first direction causes a trigger/rocker element to be placed in a cocked position in which actuating springs are tensioned, which subsequent rotation of the lever causes the trigger to return to a rest position, the spring energy being directed to actuate a spray valve. A following rotation of the lever in the first direction reloads the mechanism for the next spray.

13 Claims, 11 Drawing Sheets

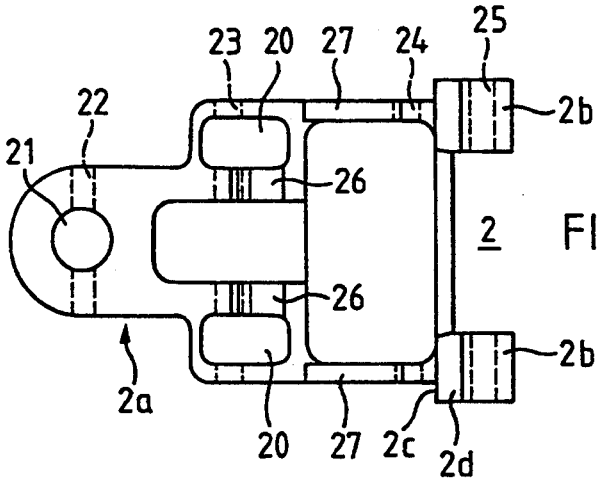
FIG. 7a
FIG. 7c
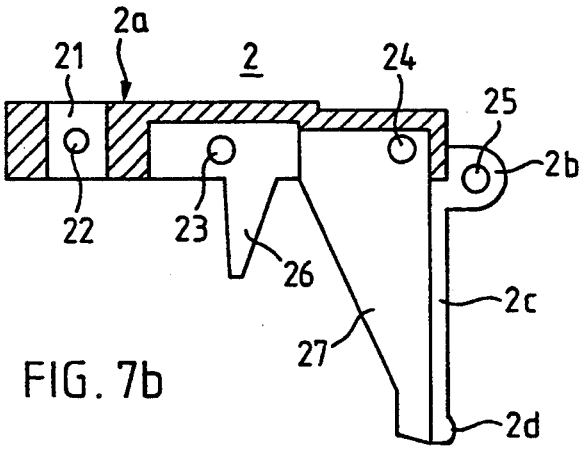
FIG. 7b
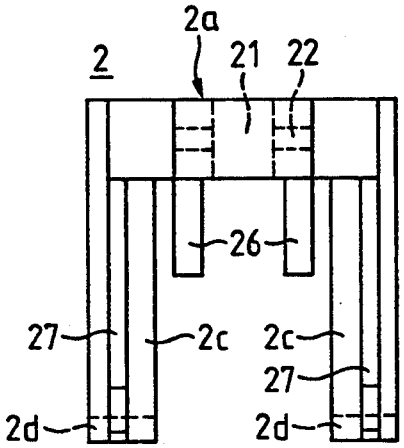
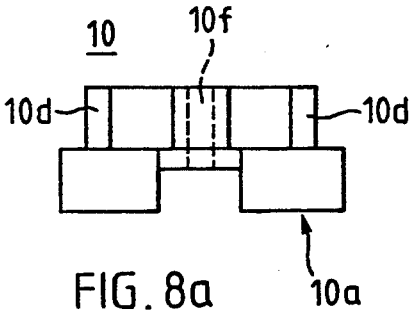
FIG. 8a
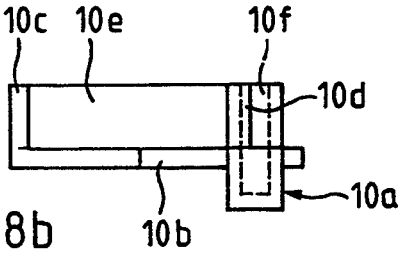
FIG. 8b
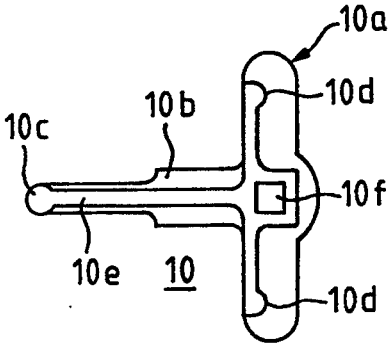
FIG. 8c

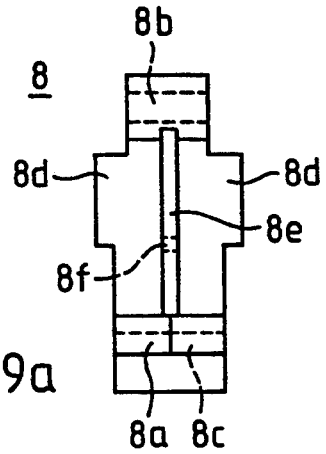
FIG. 9a
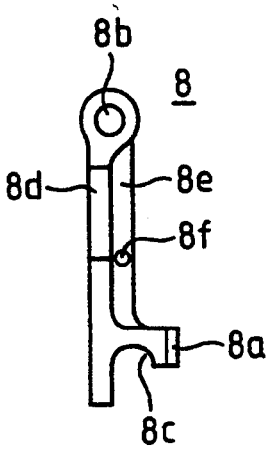
FIG. 9b
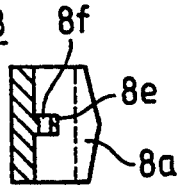
FIG. 9c
FIG. 10a
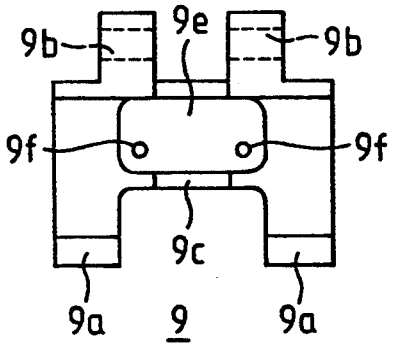
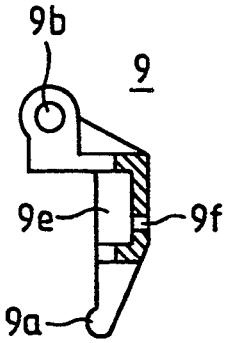
FIG. 10c
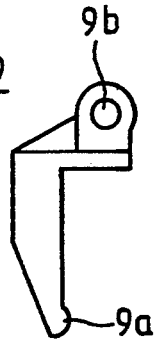
FIG. 10d
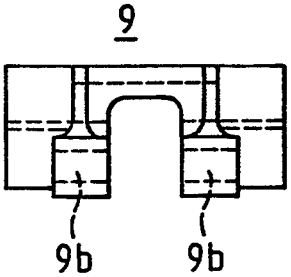
FIG. 10b FIG. 11b
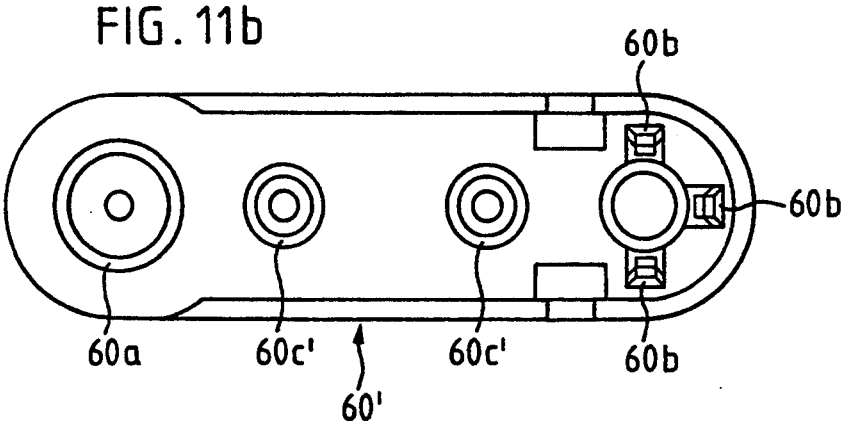
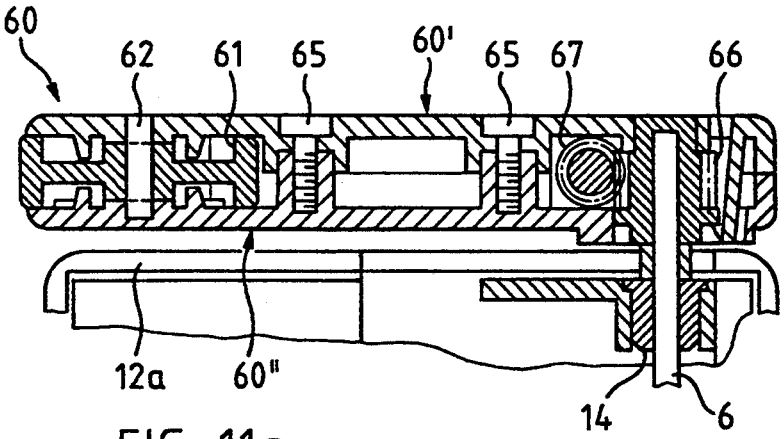
FIG. 11a
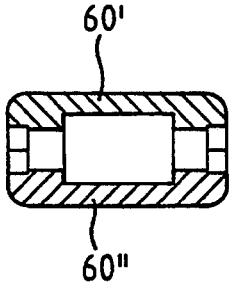
FIG. 11a'
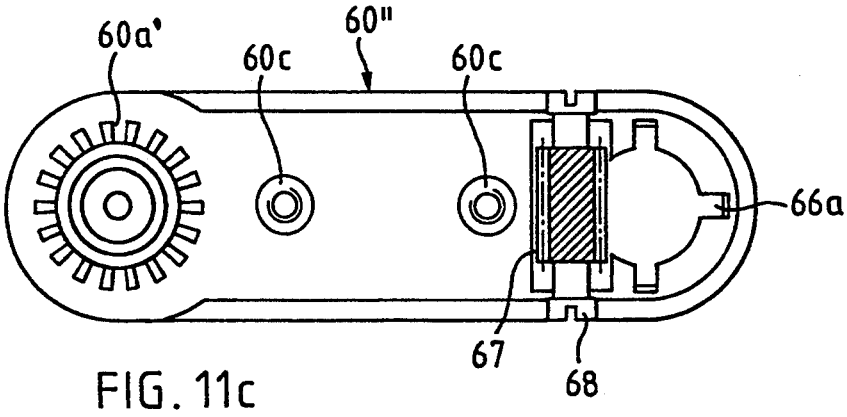
FIG. 11c FIG. 14
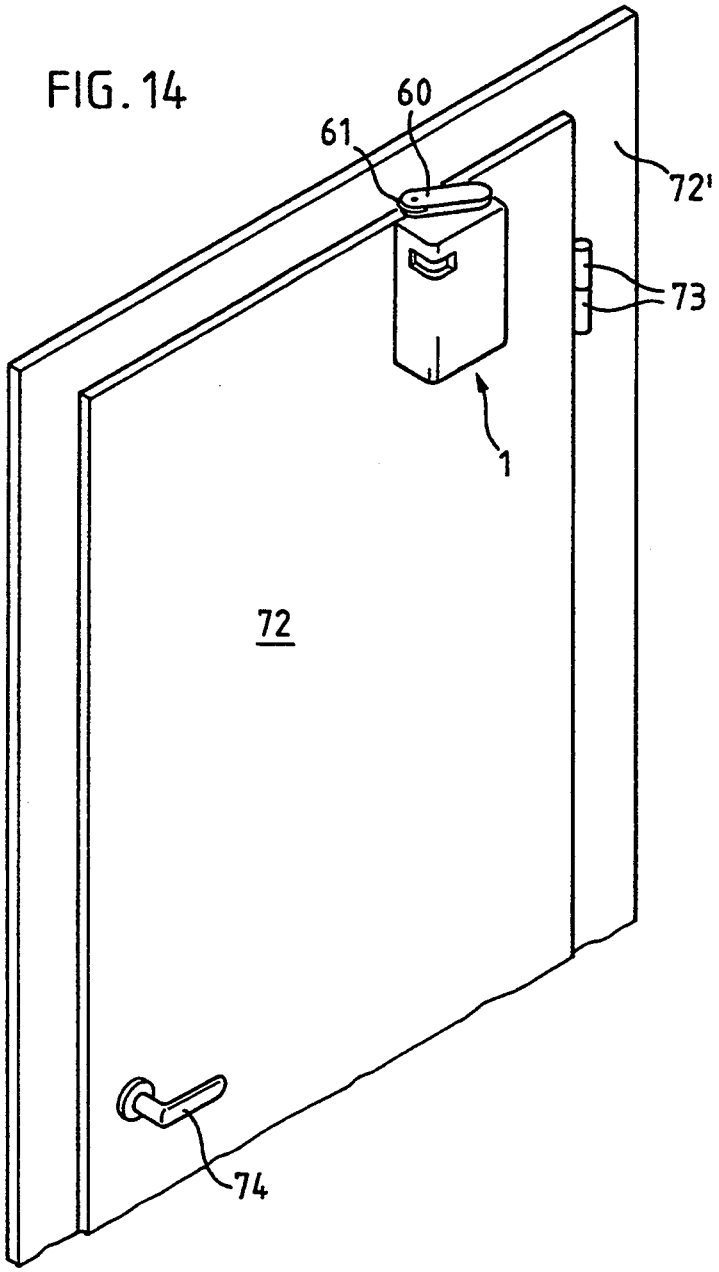
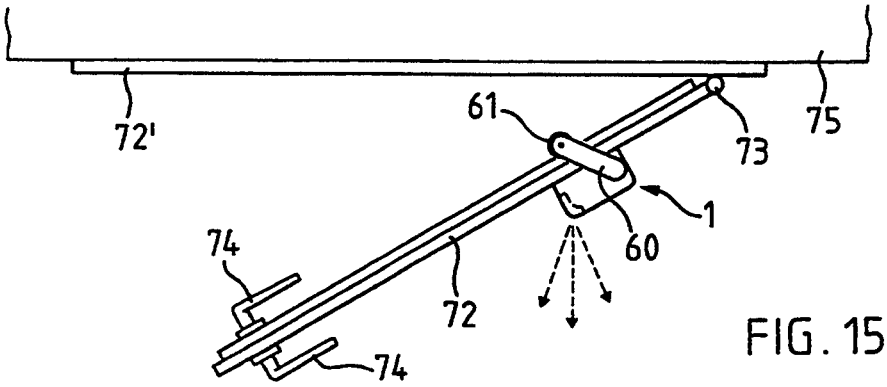
FIG. 15

ROOM SPRAY DISPENSER

The disclosure of Swiss priority application No. 02 609/92-7, filed Aug. 21, 1992 is incorporated herein by reference.

The present invention relates to a room spray dispenser with a triggering mechanism, wherein a dispenser is arranged in the room spray dispenser, having a receptacle for, or with, an odor-neutralizing and/or deodorizing liquid to be atomized, the neck of the receptacle containing a valve body with pump and nozzle, wherein an impact lever is provided, biased in direction of the valve body by means of at least one spring, and wherein this impact lever is provided with a cocking and detaining device.

The invention furthermore relates to a preferred use of the object thereof.

The EP-BI-0 127 573 teaches a room spray dispenser according to the preamble of claim 1. While this dispenser has proved itself, it requires an accurate positioning in the room or on the door, in order to prevent persons from getting sprayed. The adjustment possibilities are relatively limited, as triggering of the dispenser is effected via a linearly actuated triggering lever, a similarly actuatable cocking lever being provided for cocking. Also, due to the kinematics of the arrangement, relatively large forces have to be applied, which require a correspondingly careful mounting of the room spray dispenser, especially on doors.

It is thus one of the objects of the invention to produce a device that has such dimensions as not to impair actuation of the door, that requires no, or only a minimum of, fasteners causing damage, and that can be so located as to prevent the spray produced from falling on persons, e.g., using lavatories or toilet rooms.

According to the invention, this is achieved by providing a swivel shaft to which is fixedly attached a swivel level which, in a swung-out position, raises and cocks the impact lever, in an intermediate position moves the lever into a safe position and, in its position of rest, releases the lever for spraying.

The inclusion of a swivel shaft, that is, triggering effected on a circular segment, and a corresponding cocking of the mechanism, ensures accurate control motions and requires only slight forces absorbable by rolling friction.

A particular advantage of the room spray dispenser resides in its simple mounting procedure, requiring, due to its large mounting surface, only a minimum of mechanical means.

The following depending claims describe the advantageous further development of the object of the invention.

The swivel lever is functionally advantageous and subject to slight wear only.

The rocker-like impact lever is easily cocked and triggered.

The detaining/triggering rocker is kinematically advantageous, due to its being arranged on the impact lever.

The inclusion of a supporting roller ensures, due to the resulting linear contact with the detaining/triggering rocker, an accurate triggering with only minimal torques required.

A detaining/triggering rocker loaded by a resetting spring yields the advantage of well-defined functional stages.

The resetting rocker advantageously serves to produce a basic state of the functions without need for an extraneous auxiliary energy.

The polygonal swivel shaft is in the simplest case a square shaft, which ensures non-slip transmission of torques.

Found reliable was a triggering lever with a triggering roller at its end, since thereby the fastener means are acted upon by only minimal friction forces and correspondingly slight shear forces.

The design of the triggering lever facilitates very simple and precise adjustment of the desired "control functions" of the device.

A two-part triggering lever is advantageous from the design point of view and permits the economical manufacturing thereof.

It is often practical to mount the triggering lever inside a door opening.

A cranked triggering lever facilitates the bridging of larger triggering distances, while still permitting the retaining of preselected mounting locations for the device.

Figure 1:
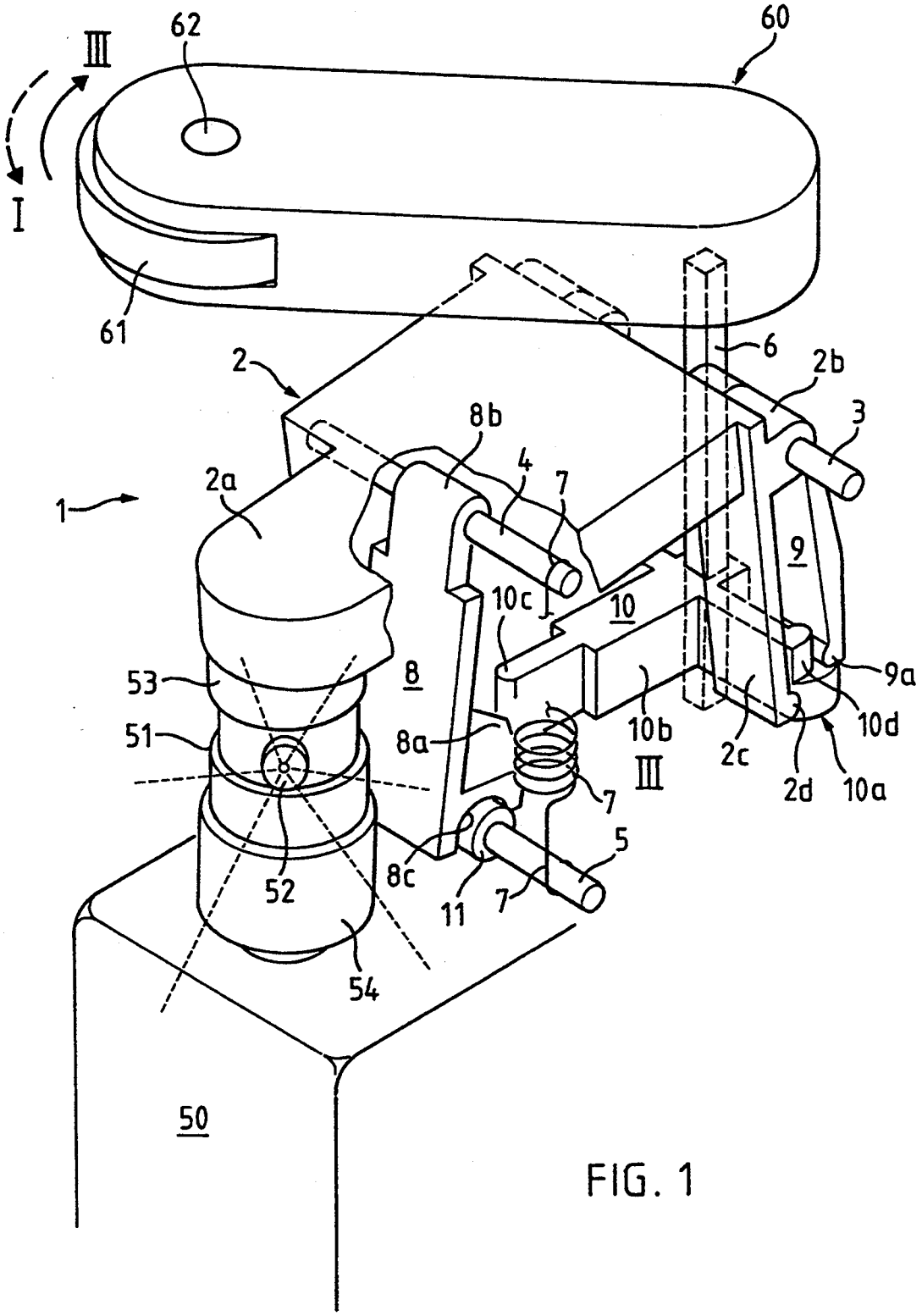
FIG. 1 is a simplified representation of a room spray dispenser during the spraying process.
Figure 2:
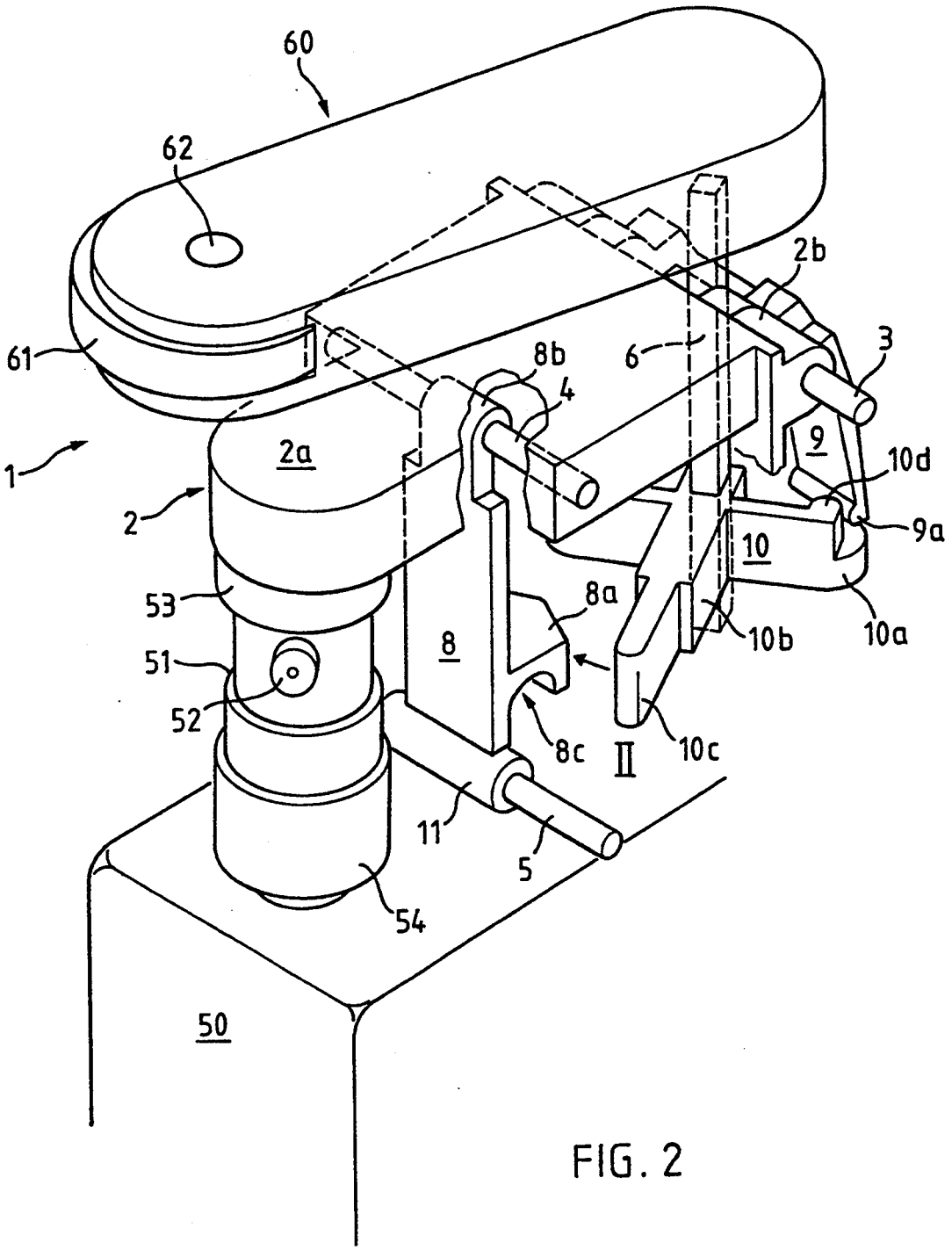
FIG. 2 shows the room spray dispenser of FIG. 1 in the safe position.
Figure 4:
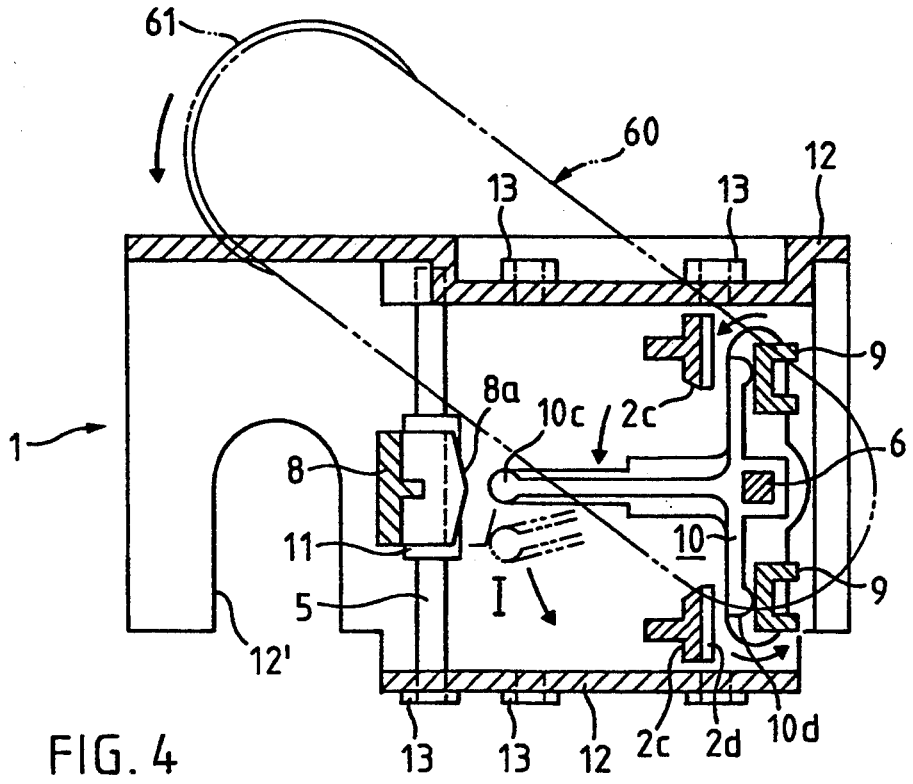
Figure 5:
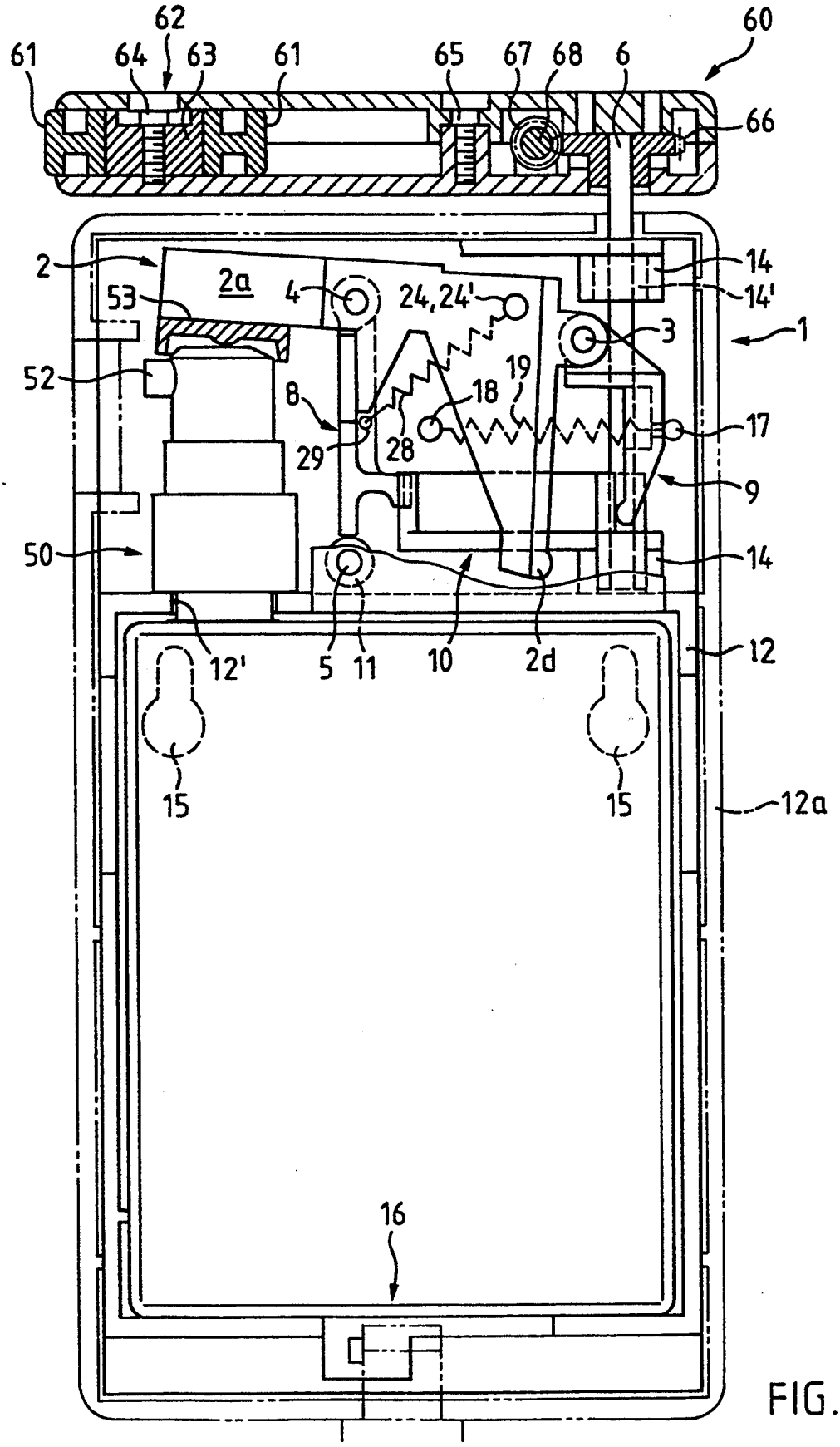
Figure 6:
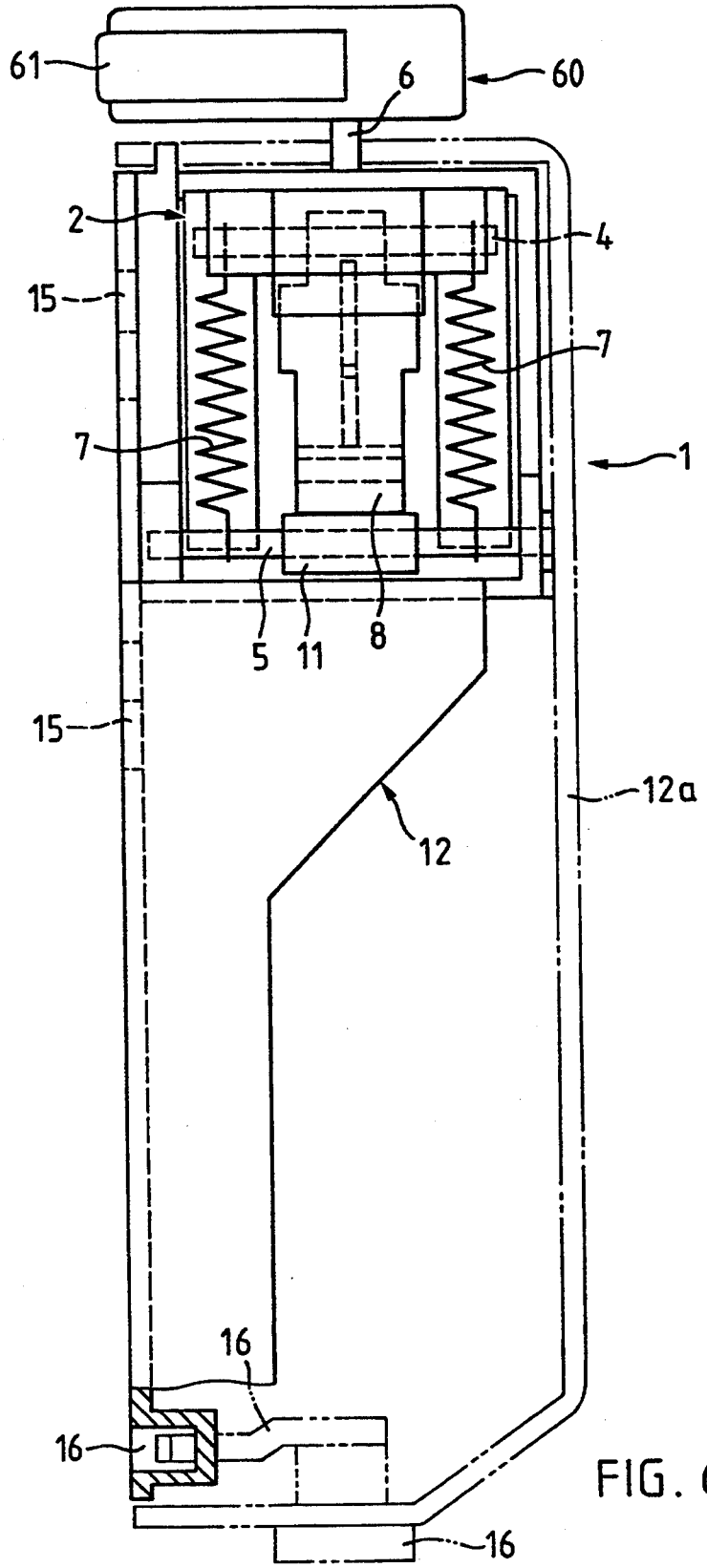
Figure 12A:
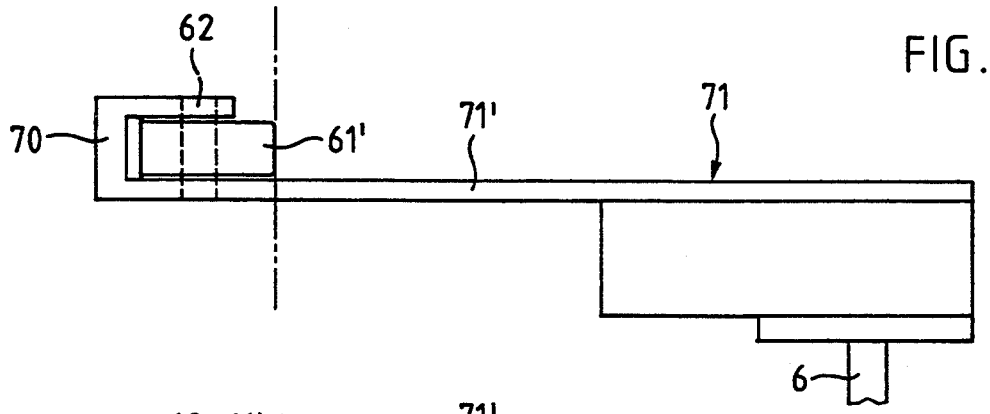
Figure 12B:
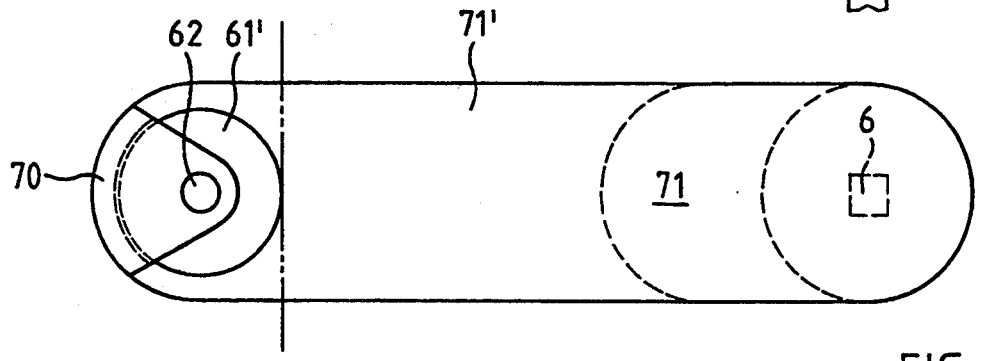
Figure 13A:
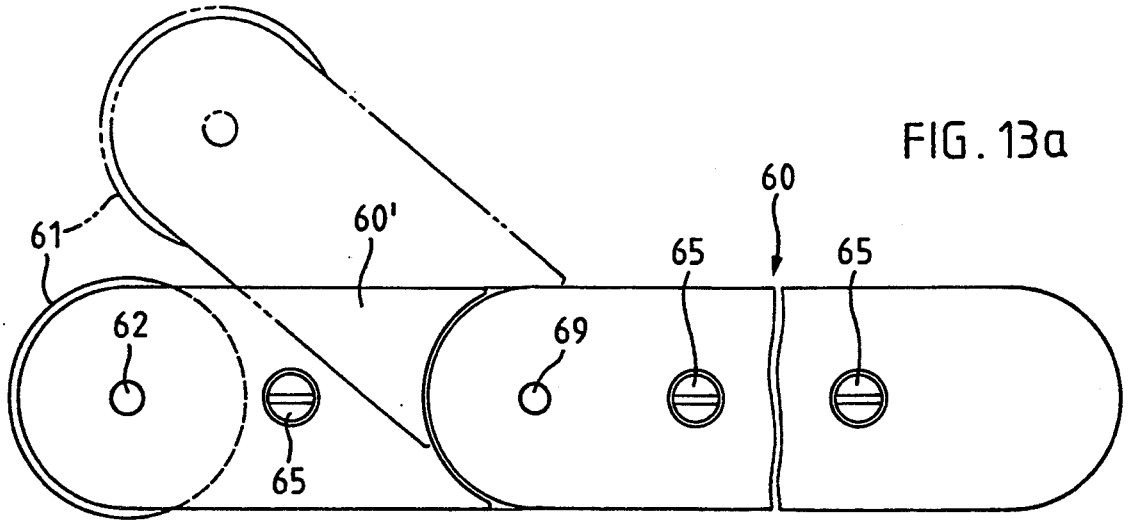
Figure 13B:
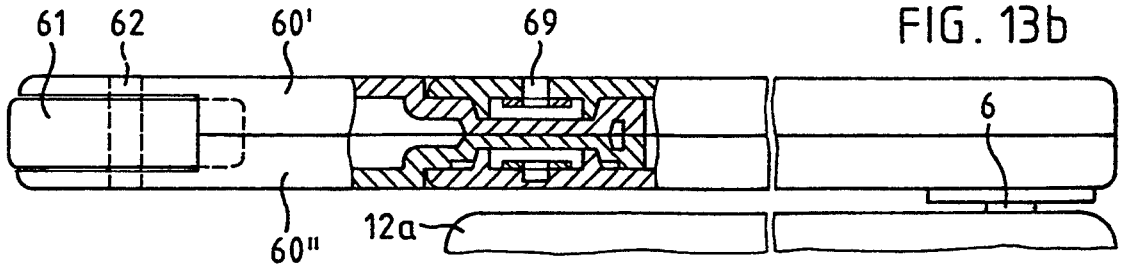

FIG. 4 showing the initiation of the triggering process, including the respective positions of the swivel lever;

FIG. 5 is an embodiment of the room spray dispenser in a vertical partial cross-section, with a first version of a triggering lever;

FIG. 6 is the representation of FIG. 5, rotated by 90°;

FIGS. 7*a*–7*c* show the rocker-shaped impact lever of FIG. 1, FIG. 2 in a bottom view, in a cross-sectional elevation and/in a side view;

FIGS. 8*a*–8*c* show the swivel lever, FIG. 1, FIG. 2, in three views;

FIGS. 9*a*–9*c* show the detaining/triggering rocker, FIG. 1, FIG. 2, in three views;

FIGS. 10*a*–10*d* represent the resetting rocker of FIG. 1, FIG. 2 in four views;

FIGS. 11*a*–11*c* show a triggering lever slightly changed relative to that of FIG. 1;

FIGS. 12*a*, 12*b* show variants of the triggering lever of FIGS. 11*a*–11*c* for limited space conditions;

FIGS. 13*a*, 13*b* show a joint-like triggering lever for the bridging of longer triggering distances;

FIG. 14 illustrates a characteristic way of mounting a room spray dispenser on a door opening into the room;

FIG. 15 illustrates the functioning of the triggering of the spraying process on the door of FIG. 14, and FIGS. 16*a*–16*c* illustrate, by way of example, the mounting and manner of operation, of a room spray dispenser on a door opening towards the outside.

The following is a more detailed description, aided by drawings, of a preferred embodiment of the object of the invention.

In FIG. 1, a schematically represented room spray dispenser is designated with numeral 1. The dispenser is in a functional state characterized by the numeral III, namely in the operational state: "Spray".

FIG. 1 shows an impact lever 2 designed as an angular rocking lever. This impact lever has a frontal hammer portion 2*a* and, at the rear, bearing lugs 2*b* integral with two levers 2*c* having noses 2*d*. In the bearing lugs 2*b* is mounted a shaft 3 supported on its end in a housing (not shown).

A further shaft 4, accessible from below, serves as a mounting location for a bearing lug 8*b* of a detaining/-triggering rocker 8. The latter is provided at its end with a rearwardly pointing cam element 8*a*.

The cam element 8*a* rests with its recess 8*c* on a supporting roller 11 designed as a bushing, which is rotatably mounted on a stationary shaft 5.

Between the shafts 4 and 5 there extend two helical springs 7 capable of storing the kinetic energy for the actuation of the atomizer pump of a commercially available dispenser 50 (CWS AG, Switzerland).

A vertically arranged swivel shaft 6 of a square cross-section is led through, the rear central portion 10*b* of a three-armed swivel lever 10. Against camming surfaces 10*a* with noses 10*d* rests a spring-loaded resetting rocker 9 (spring not shown) with its two noses 9*a*. By swiveling a triggering lever 60 in the clockwise sense, in which lever 60 the upper portion of the square shaft 6 terminates, the swivel lever 10 is swung aside. As a result, the front-side triggering nose 10*c* of the swivel lever 10 makes contact with the cam element 8*a*, deflecting the latter from the vertical and, see FIG. 2, causes it to drop with its recess 8*c* onto the supporting roller 11. At the same time, the swivel lever 10 tilts the spring-loaded impact lever 2 about its shaft 3 into a slanting position.

From FIG. 1, in conjunction with FIG. 2, it is easily seen that the cam element 8*a* projects into the swivel path of the triggering nose 10*c* which is thus able to tilt the part 8 from its vertical position, FIG. 2.

The functional state II represented in FIG. 2 corresponds to the operational state: "Safe"; the room spray dispenser 1 is ready for state III, as shown in FIG. 1.

If now the triggering lever 60, FIG. 1, with its triggering roller 61 centered around its pivot 62 is swiveled in direction of the dash-dotted arrow (counter-clockwise sense), the operational state: "Cocking" is produced.

Via the shaft 6, the swivel lever 10 is now swung out in direction towards the observer; one of the camming surfaces 10*a* engages the lefthand nose 2*d* of one of the lever arms 2*c* and, while tensioning the springs 7, lifts the impact lever 2 with its hammer portion 2*a* into an upper terminal position. At the same time, the detaining/triggering rocker 8 is pulled onto the supporting roller 11 by a resetting spring 28 (not shown in this drawing) and eventually set down on this roller 11, to touch the latter along a line. Thus the functional state II, FIG. 2, is re-established.

Figure 3:
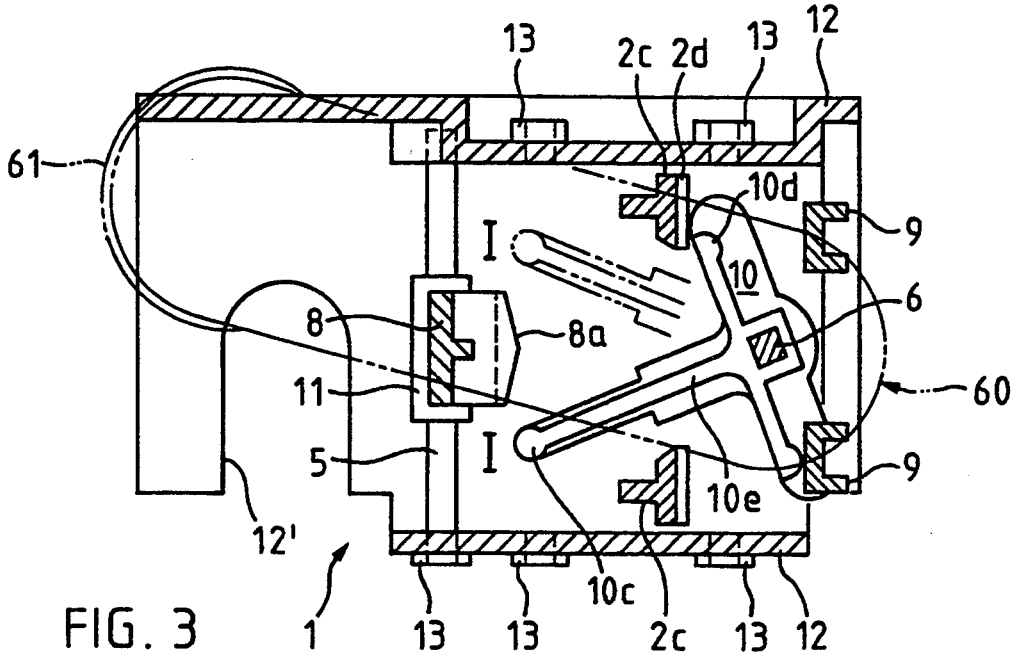
FIG. 3 is a simplified top view in partial cross-section, the characteristic angular positions of the swivel lever being represented.

The characteristic positions of the swivel lever 10*a*–10*c* in its possible swung-out locations I are shown in FIG. 3, from which it can be learned that according to the adjustment of the triggering lever 60 with its triggering roller 61, the lever 60 leads to a left-side or, optionally, right-side actuation of the device, whereby the swivel lever 10 acts on the left-side, respectively right-side nose 2*d* of the impact lever 2 (see FIG. 1).

The above-described positions correspond to the solid lines in FIG. 3; the equally possible ones, to the dash-dotted position of the swivel lever 10 or its camming surface 10*a*.

It is further seen that in these two terminal positions I it is always the opposite nose 10*d*, that rests against a part of the resetting rocker 9.

A comparison of FIG. 3 and FIG. 4 shows that a swivel lever 10 located in its central position will produce the operational state "Spray" represented in FIG. 1.

A further actuation of the lever 60 in the direction marked in FIG. 4 (in the counter-clockwise sense) will return the impact lever 2, FIG. 2, to its horizontal position, restoring the state II, i.e., "Safe".

FIGS. 3 and 4 further show the walls 12 of the device including the horizontal bearing bushings 13 arranged in them for the shafts 3, 5 and 18 (FIG. 5). Also shown in FIGS. 3 and 4 is a slot 12′ to accommodate the neck of the bottle with the spraying liquid.

Further details concerning the structural design of the object of the invention, as well as variants of the triggering lever which is indispensible for the operation, are seen in the following drawings:

The partial cross-section of FIG. 5 again shows the functional components already depicted. In addition, it is seen that, at the hammer portion 2*a* of the impact lever 2, there is arranged a replaceable anvil piece 53 which is capable of impacting the conventional atomizing pump of the dispenser 50 in a hammer-like manner. It is further seen that a resetting spring 28 is provided, which, with its ends, hooks on one side onto a shaft 24′ mounted in bores 24, and, on the other side, into a hole 29. Similarly, a pull-up spring 19 is arranged between a mounting rod 17 in the resetting rocker 9 and a similar rod 18 mounted in opposite bearing bushings 13 (FIGS. 3, 4) in the walls 12 of the device.

The square, vertical swivel shaft 6 is mounted in bearing bushings 14 and rendered rotatable by bearing rings 14′. These per se known bearing rings have an inner bore of a square cross-section corresponding to the shaft 6 and are cylindrical on the outside, being a sliding fit in the bushings 14.

The wall 12 of the device is fully covered by a conventional cover 12*a*, all components of the device thus being protected.

Mounting slots 15 being advantageously provided in the wall 12, thus, in case of need, enabling the device to be screwed and secured to the mounting location. In addition, there is provided a locking mechanism 16 which, in a known manner, can be operated with the aid of a special key.

Of particular importance is the structural design of the two-part triggering lever 60. The cross-sectional representation in the upper part of FIG. 5 shows all essential details: The "triggering roller 61, its pivot 62 and journal 63, and the screw 64. On the swivel shaft 6 there is fixedly mounted a worm wheel 66 in which engages a worm 67, having at both ends screw shafts 68. The triggering lever 60 has an upper lever housing and a lower housing which are fixedly attached to on another by at least one screw 65.

FIG. 6, rotated relative to FIG. 5, reveals further details from FIGS. 1–4, seen in particular are two springs 7, suspended at their ends on shafts 4 and 5, respectively. Also seen is the design of the walls 12 and the cover 12′.

FIGS. 7*a*–7*c* represent the impact lever 2 in all its details. In the hammer portion 2*a* there is provided a centering bore 21 for the anvil piece 53. A pinning hole 22 crosses the bore 21 to secure the anvil piece 53. Also seen are the bores 23 for the shaft 4, the bore 24 for the shaft 24′ of the resetting spring 28 and the bore 25 for the shaft 3 in the bearing lugs 2*b*.

The recess 20 seen in FIG. 7*a* serves to permit the attachment of springs 7 to the shaft 4, see also FIGS. 1 and 6.

The angular impact lever 2 (see FIGS. 7*b* and 7*c*) is reinforced by rigidifying ribs 27 and can thus be mechanically loaded.

The swivel lever 10, FIGS. 8*a*–8*c*, represented in three different views, is of a three-armed design, see FIG. 8*c*. The square bore 10*f*, fitting the shaft 6, passes through the component. The two camming surfaces 10*a* are provided with noses 10*d*. The central portion 10*b* has a reinforcing rib 10*e* which merges with the triggering nose 10*c*.

The detaining/triggering rocker 8, FIGS. 9*a*–9*c*, has also a reinforcing rib 8*e*, in which is located the hole 8*f* for the spring 28 (see FIG. 5). In the upper portion of the rocker 8 there is located the bearing lug 8*b* and at the end, the recess 8*c* which fits the supporting roller 11. The obtuse-angled design of the cam element 8*a* is clearly seen in FIG. 9*c*.

FIGS. 10*a*–10*d* represent the resetting rocker 9 in four different views. The elevation, FIG. 10*a*, shows the two noses 9*a* and, between them, the recesses 9*c* and 9*e*. Also seen in the recess 9*e* are two holes 9*f* for the pull-up springs 19. The recess 9*c* serves for unhindered passage of the square swivel shaft 6 (FIGS. 1, 2). The outer shape and cross-sectional shape of the resetting lever 9 are clearly seen in FIGS. 10*a* and 10*b*.

The resetting rocker 9 is guided by the shaft 3 (FIG. 1) in a bore 9*b*.

Due to the triggering lever 60 (FIGS. 11*a*–12*b*) which is adaptable to different conditions, the object of the invention is easily adapted to almost any desired location.

This is also facilitated by the per se already proven design of the dispenser 50, by means of a rotatable, i.e., in its spray direction adjustable, nozzle 52 in the valve body 51.

The design of the triggering lever 60 according to FIGS. 11*a* and 11*a*′ substantially corresponds to that seen in FIG. 5. What has been simplified here is the pivot 62. The two lever housing halves 60′, 60″ (FIGS. 11*b*, 11*c*) have additional supporting rings 60*a* and furthermore, in the lower part 60″, a ribbed ring 60*a*′ and in the upper part 60′ additional stops 60*b* for the worm wheel 66 provided with abutment noses 66*a*. Dowels 60*c* in the lower lever housing half 60″ are centered in dowel sockets 60*c*′ in the housing half 60′ and serve for accurate joining by means of screws 65.

The ribbed ring 60*a*′ according to FIG. 11*c* is also used in the variant of FIGS. 13*a* and 13*b*.

According to FIG. 13*a*, this triggering lever 60 is articulated and can be adjusted for the bridging of larger triggering distances. To this end, two upper and two lower lever housing halves 60′ and 60″ respectively are screwed together at the desired angular position.

With limited space conditions, especially when the triggering lever must be led through the upper gap of a door, a triggering lever 71′ according to FIGS. 12*a* and 12*b* is of help. Here, the pivot 62 is mounted in a yoke 70. The triggering roller 61′ is of a smaller diameter and is purely discoid, without further recesses. The flat portion 71′ of the lever 71 is so dimensioned that it will pass through the upper door gap, without touching the door. The triggering lever 71 can be mounted in whatever way on the opposite side of the door frame or on the frame itself.

The universal mountability of the object of the invention is clearly perceived with the aid of FIGS. 14–16*c*:

In FIG. 14, the room spray dispenser is in the usual way screwed to a door panel 72, with the door hinge 73 facing the room and the triggering lever 60 touching the door frame 72′ when the door is closed. If now the door handle 74 is opened in the usual way, the spraying process is triggered according to FIG. 1, as represented in FIG. 15.

For the sake of completeness, the room wall is marked with numeral 75.

Figure 16A:
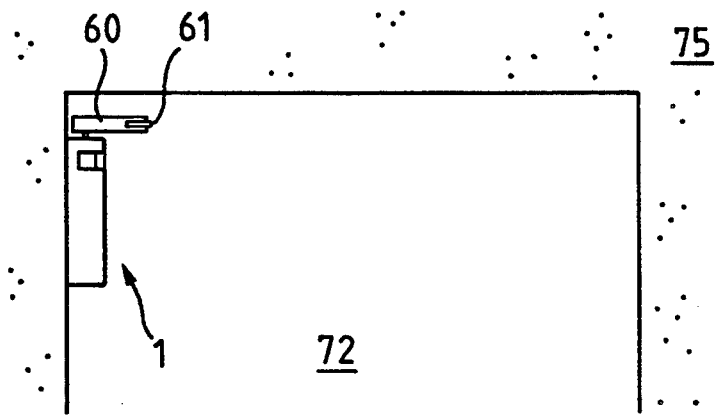
Figure 16B:
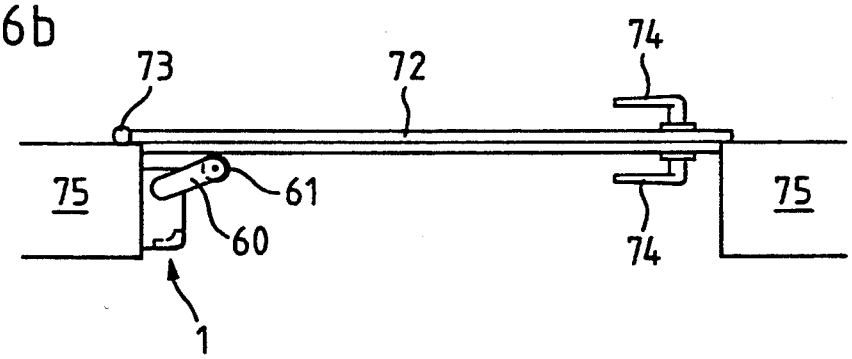
Figure 16C:
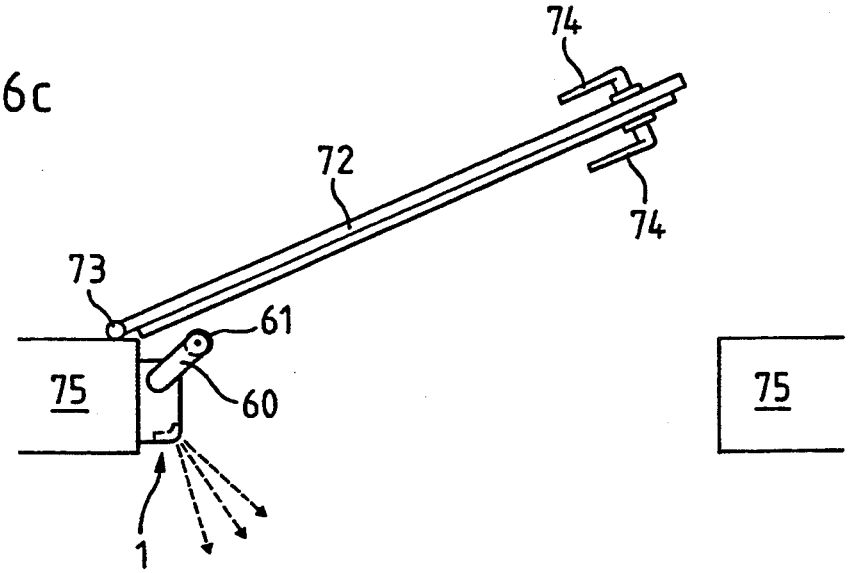

As represented in FIGS. 16*a*–16*c*, the room spray dispenser 1 is mounted directly on the door opening of the wall 75. The door hinge 73, too, is directly attached to the wall 75.

In spite of these very rudimentary mounting conditions, the triggering lever 60 can be precisely adjusted by rotation of the worm 67 by means of a screwdriver engaging the slot in the screw shaft 68, e.g., in FIG. 11*c*. No added wear can occur, as all inaccuracies in shutting the door are translated into a rolling motion and, thus, into a stroke of the triggering lever 60.

The object of the invention is advantageously made of commercial plastics. With the exception of the shafts, the transmission parts (worm, worm wheel) and the fasteners and springs, proven and wear-resistant polymers can be used.

The above-described self-locking worm wheel 66 maintains the angular position of the triggering lever 60 relative to the impact lever 2 as set with regard to the geometric conditions, so that the room spray dispenser 1 can be operated for an extended period of time without readjustment.

With the lever variants shown, practically all conceivable mounting problems can be solved.

As the greatest advantage, however, appears the possibility of arranging the room spray dispenser 1 at any location without the spraying process offensively affecting people.

The slight triggering and cocking moments required permit in most cases the simplest mounting of the device by way of attachment with the aid of double-sided adhesive mounting tape.

This end is also served by setting the angle at the triggering lever 60, since this, indirectly, via the path-length, reproducibly sets a time delay of the spraying process relative to triggering by the door movement.

The device according to the invention is obviously not limited to use in toilets and to actuation by a door movement. It could also be used in rooms in which smokers stay. Equally conceivable is the mounting of the room spray dispenser in the region of windows, blinds, flushing cisterns, etc., so that the spraying process is triggered after the airing of a room, or after flushing, for the scenting of the room.

| Nomenclature | |
|---|---|
| 1 | Room spray dispenser |
| 2 | Impact lever (angular rocker) |
| 2a | Hammer portion of 2 |
| 2b | Bearing lugs of 2 |
| 2c | Lever arms of 2 |
| 2d | Nose of 2 |
| 3, 4, 5 | Shafts |
| 6 | Swivel shaft |
| 7 | Springs |
| 8 | Detaining/triggering rocker |
| 8a | Cam element of 8 |
| 8b | Bearing lug of 8 |

-continued

| | |
|---|---|
| 8c | Recess in 8 |
| 8d | Flank portions |
| 8e | Reinforcing rib |
| 8f | Hole (spring 28) |
| 9 | Resetting rocker |
| 9a | Noses |
| 9b | Bore |
| 9c | Recess for shaft |
| 9e | Recess |
| 9f | Hole |
| 10 | Swivel lever |
| 10a | Camming surfaces of 10 |
| 10b | Central portion of 10 |
| 10c | Triggering nose |
| 10d | Noses |
| 10e | Reinforcing rib |
| 10f | Square bore |
| 11 | Supporting roller (bushing) |
| 12 | Walls of device |
| 12a | Cover of device |
| 12' | Centering slot for neck of receptacle for spraying liquid |
| 13 | Bearing bushings (horizontal) |
| 14 | Bearing bushings (vertical) |
| 14' | Bearing ring |
| 15 | Mounting slots |
| 16 | Locking mechanism |
| 17, 18 | Mounting rods (shafts) for springs |
| 19 | Pull-up springs |
| 20 | Recess |
| 21 | Centering bore for anvil piece |
| 22 | Pinning hole (for 21) |
| 23 | Bore for shaft 4 |
| 24 | Bore for shaft 24' |
| 24' | Shaft (resetting spring) |
| 25 | Bore for shaft 3 |
| 26 | Abutment noses |
| 27 | Reinforcing ribs |
| 28 | Resetting spring |
| 29 | Hole |
| 50 | Dispenser (conventional atomizer pump with receptacle) |
| 51 | Valve body |
| 52 | Nozzle |
| 53 | Anvil piece (replaceable) |
| 54 | Neck (threaded cap) |
| 60 | Triggering lever |
| 60' | Upper lever housing |
| 60'' | Lower lever housing |
| 60a | Supporting ring |
| 60a' | Ribbed ring |
| 60b | Stops (abutment noses) |
| 60c | Dowel |
| 60c' | Dowel socket |
| 61, 61' | Triggering rollers |
| 62 | Pivot |
| 63 | Journal |
| 64, 65 | Joining screws |
| 66 | Worm wheel |
| 66a | Abutment noses |
| 67 | Worm |
| 68 | Screw shaft (axis of 67) |
| 69 | Bore |
| 70 | Bearing yoke |
| 71 | Triggering lever for mounting on wall opening |
| 71' | Flat portion of 71 |
| 72 | Door panel |
| 72' | Door frame |
| 73 | Door hinge |
| 74 | Door handle |
| 75 | Wall |
| I | Functional state (terminal position), transition to operational state "Cock" |
| II | Functional state corresponding to operational state "Safe" |
| III | Functional state corresponding to operational state "Spray" |

I claim:

1. A room spray dispenser comprising a receptacle for a liquid to be atomized, said receptacle having a neck bearing a spray valve comprising a nozzle and pump; an impact lever pivotly mounted for engagement with said spray valve to actuate a spray, said input lever being normally biased against said spray valve; a cocking and detaining element having a vertical swivel shaft and a swivel lever mounted to said swivel shaft for rotation about said swivel shaft in a generally horizontal plane, said cocking and detaining element being mounted such that rotation of said swivel lever in a first direction from a first position to a second position raises said impact lever away from the biased position against said spray valve and rotation in a second direction from said second position to said first position releases said impact lever for return towards said spray valve to actuate a spray and to place said impact lever into a safe position.

2. The room-spray dispenser as claimed in claim 1, wherein the swivel lever comprises a central arm and first and second arms located at opposite sides of said central arm and at right angles thereto, said central arm having a distal end terminating in a triggering nose, said first and second arms each having a distal end terminating at a nose and camming surface.

3. The room spray dispenser as claimed in claim 1, wherein said impact lever has a hammer portion mounted at an angle to a pair of lever arms, said impact lever further comprising means for rotation about a horizontal axis.

4. The room spray dispenser as claimed in claim 3, further comprising a resetting rocker mounted upon a shaft for engagement with at least one of said camming surface noses of said first and second arms, and a spring joined to said resetting rocker to bias said rocker thereagainst.

5. The room spray dispenser as claimed in claim 1, further comprising a detaining/triggering rocker pivotly mounted to said impact lever, said detaining/triggering rocker having a cam element at a distal end.

6. The room spray dispenser as claimed in claim 5, further comprising a supporting roller mounted for engagement with said cam element of said detaining/-triggering rocker, said cam element having an edge surface and a recess, said supporting roller being adapted to be alternatively engaged with one of said edge surface and recess.

7. The room spray dispenser as claimed in claim 6, further comprising a resetting spring connected to said detaining/triggering rocker to bias said detaining/triggering rocker against said supporting roller.

8. The room spray dispenser as claimed in claim 1, wherein said swivel shaft has a polygonal cross-section.

9. The room spray dispenser as claimed in claim 1, further comprising a triggering lever mounted to a first end of said swivel shaft, said triggering lever having a rotatably mounted triggering roller mounted to a distal end thereof.

10. The room spray dispenser as claimed in claim 9, further comprising a worm-wheel mounted upon said swivel shaft and a worm mounted to said triggering lever, said worm and worm-wheel being further mounted for mutual engagement to couple said triggering lever to said swivel shaft.

11. The room spray dispenser as claimed in claim 9, wherein said triggering lever comprises first and second pivotally joined parts.

12. The room spray dispenser as claimed in claim 9, wherein said triggering lever is articulatedly bendable, having an angular position determined by the interlock of dispenser housing parts.

13. The room spray dispenser as claimed in claim 1, further comprising a triggering lever mounted to said swivel shaft, said triggering lever comprising an arm of low structural height, adapted for wall-opening mounting.

* * * * *